US005290151A

United States Patent [19]

Orlando

[11] Patent Number: 5,290,151

[45] Date of Patent: Mar. 1, 1994

[54] PROCESS FOR PUMPING A MULTI-PHASE GAS-LIQUID MIXTURE BY MEANS OF THE USE OF A PUMP

[75] Inventor: Giovanni Orlando, Milan, Italy

[73] Assignees: Snamprogetti S.p.A.; Agip S.p.A., both of Milan, Italy

[21] Appl. No.: 870,766

[22] Filed: Apr. 20, 1992

Related U.S. Application Data

[63] Continuation-in-part of Ser. No. 704,849, May 20, 1991, abandoned, which is a continuation of Ser. No. 426,776, Oct. 26, 1989, abandoned.

[30] Foreign Application Priority Data

Oct. 28, 1988 [IT] Italy ..... 22450A/88

[51] Int. Cl.[5] ..... F04F 1/06

[52] U.S. Cl. ..... 417/54; 417/103; 417/122

[58] Field of Search ..... 417/54, 65, 85, 92, 417/103, 118, 122

[56] References Cited

U.S. PATENT DOCUMENTS

| | | | |
|---|---|---|---|
| 2,350,061 | 5/1944 | Morgan | 417/85 |
| 2,478,321 | 8/1949 | Robbins | 417/103 |
| 3,416,547 | 12/1968 | Glenn, Jr. et al. | 55/166 |
| 3,486,297 | 12/1969 | Eisinga et al. | 55/21 |
| 3,556,682 | 1/1971 | Sakamoto et al. | 417/122 |
| 3,602,612 | 8/1971 | Osdor | 417/122 |
| 3,829,246 | 8/1974 | Hancock | 417/121 |
| 3,864,062 | 2/1975 | LeFur | 417/122 |
| 4,321,016 | 3/1982 | Sakamoto et al. | 417/63 |
| 4,336,763 | 6/1982 | Wolff | 417/122 |
| 4,778,532 | 10/1988 | McConnell et al. | 417/122 |

FOREIGN PATENT DOCUMENTS

| | | |
|---|---|---|
| WO8702117 | 4/1987 | PCT Int'l Appl. . |
| 1280121 | 7/1972 | United Kingdom . |
| 1441010 | 6/1976 | United Kingdom . |
| 1513132 | 6/1978 | United Kingdom . |

*Primary Examiner*—Richard A. Bertsch
*Assistant Examiner*—Michael I. Kocharov
*Attorney, Agent, or Firm*—Stevens, Davis, Miller & Mosher

[57] ABSTRACT

A process is disclosed, for pumping a multi-phase gas-liquid mixture by using a pump as the thrusting machine, and at least two pumping vessels alternatively performing functions of intake and functions of compression/delivery.

9 Claims, 3 Drawing Sheets

Figure 1:
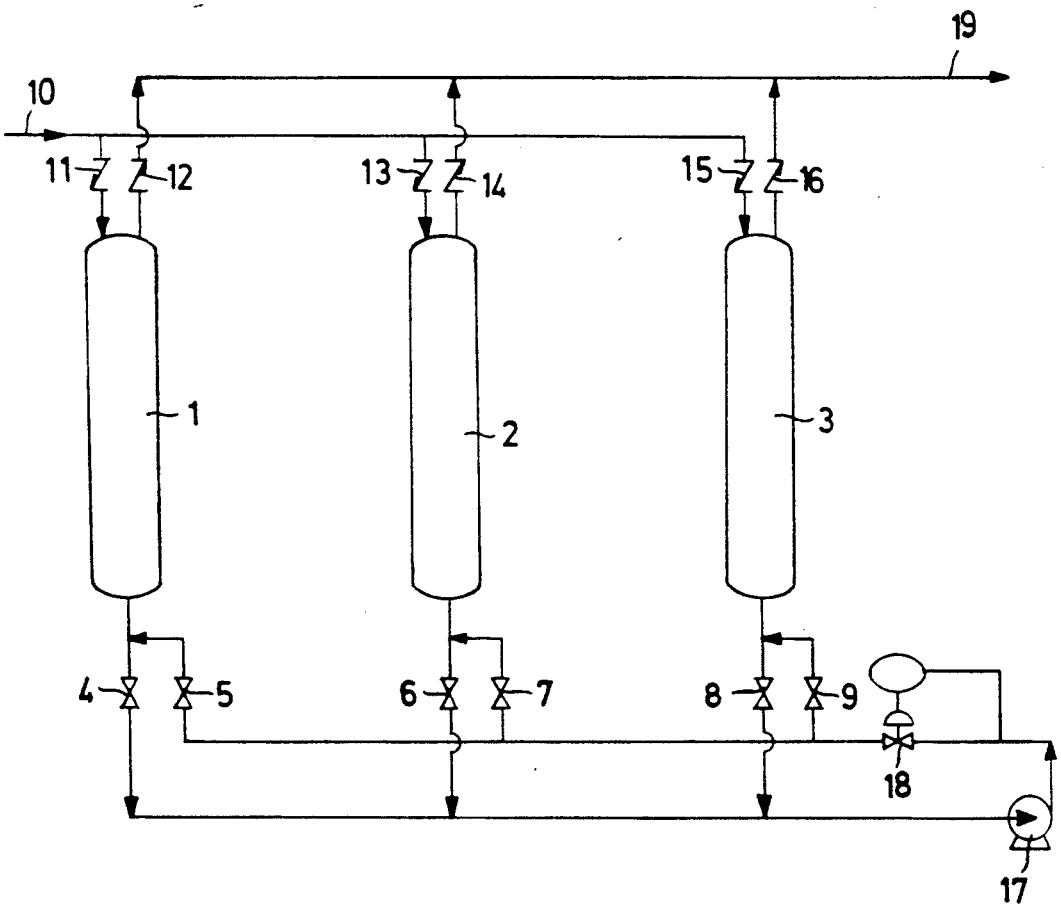

PROCESS FOR PUMPING A MULTI-PHASE GAS-LIQUID MIXTURE BY MEANS OF THE USE OF A PUMP

This application is a continuation-in-part of application Ser. No. 704,849, filed May 20, 1991, now abandoned, which in turn is a continuation of application Ser. No. 426,776, filed Oct. 26, 1989 now abandoned.

The present invention relates to a process for supplying pressure energy to a multi-phase gas-liquid mixture, and in particular to a multi-phase fluid coming from a petroleum well, by using a pump as a thrust-supplying machine. The system also can handle fluids containing small amounts of solid particles, dependent upon the amount of solids which is acceptable for the pump. The present invention is used wherein a high reliability is required in the absence of attending personnel, and with a low maintenance frequency. The present invention may be used in submarines, on non-attended offshore platforms, as well as on land, with hostile environments, or environments which are difficult from a logistical viewpoint.

The known methods and systems for pumping a multi-phase gas-liquid mixture include:

A) methods and systems based on the separation of the phases, followed by a machine (a pump) operating on the liquid phase only, and a machine (a compressor) operating on the gas phase only;

B) methods and systems based on the use of machines (multi-phase "pumps"), directly capable of handling the multi-phase mixture itself.

The systems belonging to the (A) category require the use of two machine types, one of which (the compressor) is characterized by a certain mechanical delicacy, and poor reliability.

The machines belonging to the (B) category are presently in an experimental stage. They require considerable development work and tests to be carried out before being able to reach an efficiency and a reliability at an industrial level.

It has been found that a pumping process by means of a conventional pump, makes it possible to overcome the drawbacks which affect the prior art.

The process for pumping a multi-phase gas-liquid mixture, according to the present invention, includes using a pump as the thrust-supplying machine, and at least two pumping vessels, which alternatively perform the functions of intake and the functions of compression and/or delivery.

Since the pump must only handle the liquid phase, it can be selected from among the conventional pumps, and in particular it can be a centrifugal pump.

In case only two vessels are used, they perform, always alternatively, functions of intake and functions of compression/delivery.

In case more than two vessels are used, a further stand-by function can be performed.

The present process is disclosed now, by referring to two particular operating modes.

The first operating mode when using two pumping vessels only, alternatively perform functions of intake and functions of compression/delivery; and when using more than two vessels, alternatively perform functions of intake, functions of compression/delivery, and standby functions.

Said first operating mode comprises the following steps:

a) feeding the multi-phase mixture, under the pressure of the intake line, to the vessel performing the intake functions which is full of liquid and which is acting as the gas-liquid phase separator;

b) sending the liquid separated inside the vessel performing intake functions, to the pump, by means of which it is pumped into a further vessel, full of gas under the intake pressure, which performs functions of compression/delivery, causing the gas contained inside said vessel to be compressed by the liquid initially present in the vessel performing intake functions, until the gas reaches the same pressure as that of the delivery line;

c) causing the compressed gas to leave the vessel performing compression/delivery functions, followed by an amount of liquid, which is the same as that of the system-entering liquid, with both gas and liquid being fed to the delivery line.

For such a process type, the sequence, for each vessel, in case more than two vessels are used, can be: intake, stand-by, compression/delivery; or intake, compression/delivery, stand-by.

The second operating mode uses more than two pumping vessels, which will alternatively perform functions of intake, functions of compression/stand-by, and functions of delivery.

Said second operating mode comprises the following steps:

a) feeding the multi-phase mixture, under the pressure of the intake line, to a first vessel performing intake functions which is full of liquid, and which is acting as the gas-liquid phase separator;

b) sending the separated liquid from inside the first vessel, performing intake functions, to the pump, after which it is pumped into a second vessel which is full of gas compressed to the delivery line pressure, said second vessel performing the functions of delivery, i.e., causing the compressed gas contained inside said second vessel to leave, followed by an amount of liquid, which is the same as that of the system-entering liquid, with which said compressed gas and said liquid is being fed. After that a portion of the compressed gas is subtracted from the second vessel and is fed into a third vessel performing compression/stand-by functions, to the delivery line.

c) feeding to the third vessel full of gas under the intake pressure, performing functions of compression/-stand-by, a portion of the already compressed gas, withdrawn from the second vessel performing delivery functions, causing the gas contained inside said third vessel to be compressed, until the same pressure as that of the delivery time is reached.

For such an operating mode, the sequence, for each vessel is the following: intake, compression/stand-by, delivery.

In case a centrifugal pump is used, the use of (either pressure or flowrate controlling) regulation valves is necessary, in order to render the pump operating conditions as constant as possible.

Figure 2:
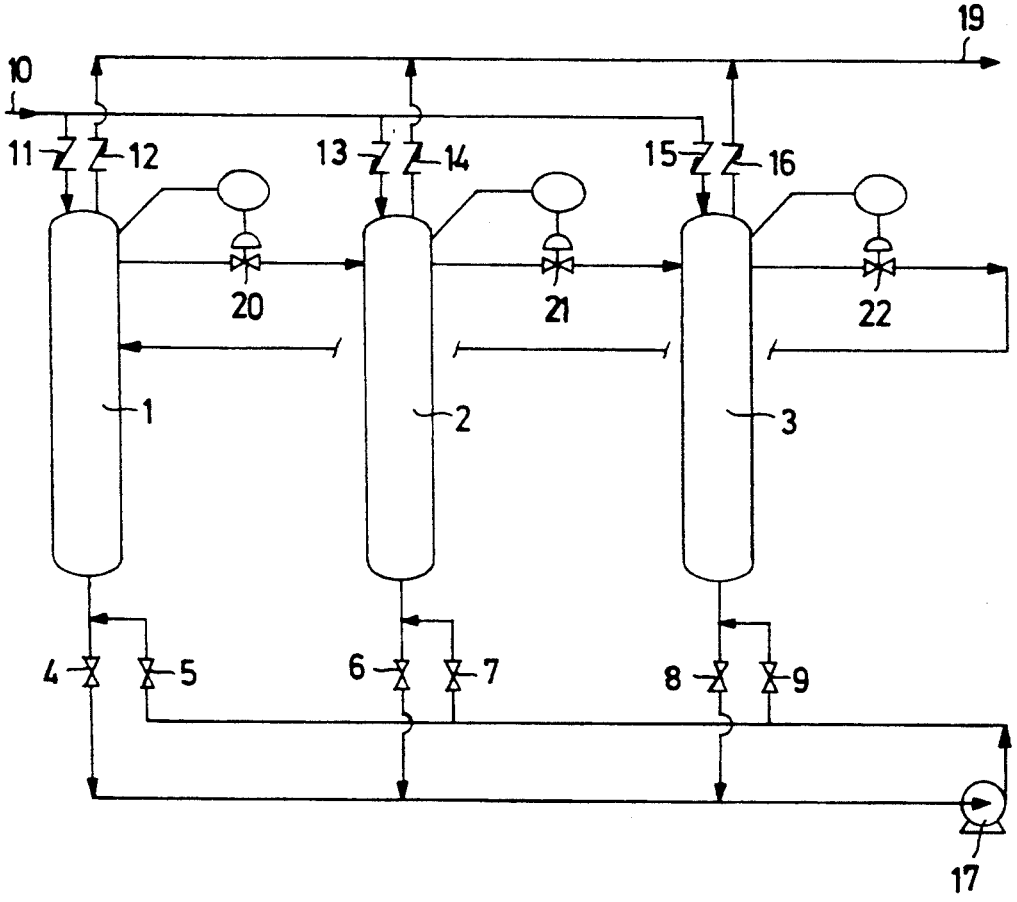
Figure 3:
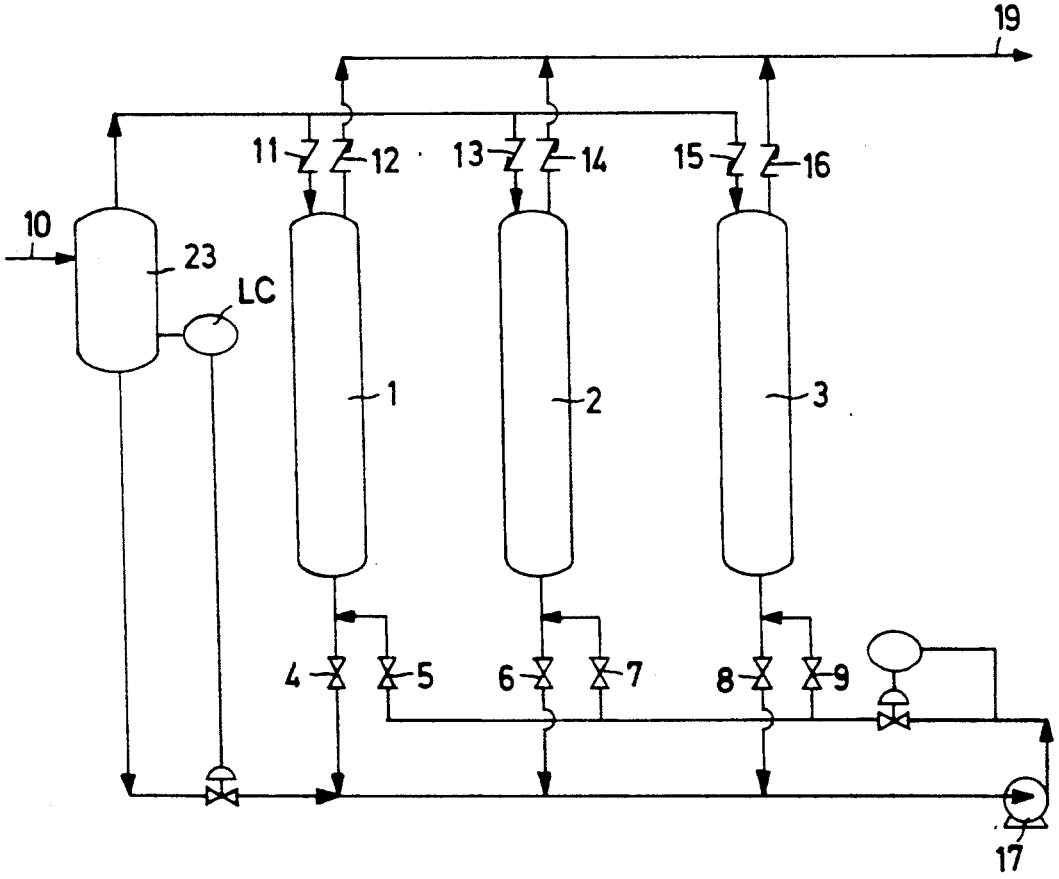

The invention will be better disclosed with the aid of the diagrams of FIGS. 1, 2 and 3, which represent preferred forms of practical embodiments, using 3 pumping vessels and one centrifugal pump, and which are not to be considered as limitative of the same invention.

The status of the pumping vessels (1, 2 and 3) is determined by the status of the on/off valves (4, 5, 6, 7, 8, 9), which is governed by a dedicated electronic logic system.

Referring to FIG. 1, let us consider, e.g., the case in which a vessel (1) is in its intake stage, the vessel (2) is in its stand-by stage, and the vessel (3) is in its compression/delivery stage. Under such conditions, the multi-phase fluid (10) enters the vessel (1) which is full of liquid through valve 11. Valves 5, 6, 7, 8, 12, 13, 14, 15, 16 are closed. Vessel (1) acts as the gas/liquid separator, while the liquid passes through the valve (4) to the centrifugal pump (17) from which, through the flow-rate regulation or pressure regulation valve (18) becomes a "liquid piston" and passes through the valve (9) into the vessel (3) (initially full of gas under the intake pressure). The "liquid piston" entering the vessel (3) causes the therein contained gas to be compressed, until a same pressure as that of the delivery line is reached. Now, the valve (16) is opened, and the gas is sent to the delivery line (19), followed by an amount of liquid, which is the same as that of the system-entering liquid. When the level of the liquid inside the vessel (1) reaches a suitable minimum value, the control logic will switch the status of the on/off valves. The vessel 1 is turned into a stand-by status when valves 4 and 11 are closed. The vessel (3) switches into its intake condition by opening valves 8 and 15. Valve 9 is closed. The vessel (2) switches into compression/delivery conditions when valve 7 is opened. Such a sequence is repeated, thus making it possible for a continuous stream of liquid to flow through the pump (17) which, thanks to the action of the regulation valve, (18), operates under nearly steady conditions. No diaphragms or separation bodies are provided between the "liquid piston" and the multi-phase fluid.

The system can also work according to a different operating cycle, which, instead of the intake/stand-by/-compression-delivery sequence (for each vessel) accomplishes the intake/compression-delivery/stand-by sequence.

An alternative configuration of the system of FIG. 1 is depicted in FIG. 2.

Let us consider, e.g., the case in which the vessel (1) is in its intake stage, the vessel (2) is in its delivery stage and the vessel (3) is in its compression/stand-by stage.

The multi-phase fluid (10) enters the vessel (1) which is full of liquid through the valve 11. Valves 5, 6, 8, 9, 12, 13, 14, 15 and 16 are closed. Valves 4 and 7 are open. Vessel (1) acts as the gas/liquid separator, while the liquid passes through the valve (4) coming to the centrifugal pump (17), where it forms into a "liquid piston". The correct operation of which is ensured by the regulator valve (21), which maintains constant the delivery pressure of the pump. Valves (20) and (22) also maintain constant pressure of the pump when vessels (1) and (3) are in the delivery stage.

The compression step is accomplished by means of the delivery of a portion of the gas phase from the delivery vessel (2) through the regulation valve (21), to vessel (3) in the compression stage, until inside vessel (3) the pressure of the delivery line is reached.

The "liquid piston" is pumped into vessel (2) through the valve (7), and in this stage it performs the function of sending a portion of the compressed gas to vessel (3) through (21) after which valve 21 is closed, and the remaining portion thereof to the delivery line (19) through opened valve (14), followed by an amount of liquid, which is the same as that of the system-entering liquid.

When the level of the liquid inside the vessel (1) reaches a suitable minimum value, the control logic will switch the status of the on/off valves. The vessel (1) turns into its compression/stand-by status (valves 4 and 11 are closed); the vessel (2) switches into intake condition (valves 13 and 6 are open, 14 and 7 are closed); the vessel (3) turns into its delivery status with valve 8 closed.

A further alternative configuration is shown in the simplified diagram of FIG. 3.

In such a diagram, a gas-liquid separator (23) is added.

This makes it possible for only gas to be sent to the upper inlet of pumping vessels, while the liquid is directly sent to the intake port of the centrifugal pump (17).

As for the rest, the operation of the diagram shown in FIG. 3 is similar to that disclosed for the diagram shown in FIG. 1.

The configuration shown in FIG. 3 transfers the function of phase (gas/liquid) separation from the pumping vessels (1, 2 and 3) to the separator (23).

An alternative possibility, valid for both of the diagrams of FIG. 1 and FIG. 3, consists in using, instead of one single regulation valve, three regulation valves (one valve per each pumping vessel), installed in cascade to the on/off valves (5, 7, 9).

One should observe that the pumping vessels can be given various configurations, i.e., horizontal, vertical vessel, etc., according to the process plan adopted (and consequently of the functions which the same vessels are required to perform), and of the characteristics of the processed fluids. For example, for the diagram of FIG. 3, since the pumping vessel must not act as a phase separator too, its reference configuration is that of a vertical vessel.

The number of the pumping vessels can be both increased and reduced (to two vessels), in this latter case a higher functional irregularity has to be accepted.

I claim:

1. A process for pumping a multi-phase gas-liquid mixture through a delivery line at a delivery line pressure comprising a) feeding said multi-phase mixture from a pressurized intake line, under the pressure of said intake line, to a first vessel full of liquid, separating the multi-phase mixture in said first vessel into a gaseous phase and a liquid phase;

b) simultaneously with the gas-liquid separation sending the liquid present in said first vessel and the liquid separated inside the first vessel to a pump, by means of which the liquid is pumped into a second vessel, full of gas under the intake line pressure, causing said gas contained inside said second vessel to be compressed by said liquid initially present in said first vessel, until said gas reaches a pressure equal to that of said delivery line; and c) causing the compressed gas and compressing liquid to leave the second vessel and enter said delivery line by introducing more liquid from said first vessel into said second vessel through said pump, the amount of liquid leaving said second vessel being the same as that of the liquid entering the first vessel.

2. A process for pumping a multi-phase gas-liquid mixture through a delivery line at a delivery line pressure comprising passing the mixture into a first vessel full of liquid from an intake line under pressure, separating liquid from said liquid gas mixture in said first vessel, simultaneously passing said liquid in said first vessel and said separated liquid through an operating pump to create a liquid piston, passing the liquid piston into a gas containing second vessel to build pressure within said vessel to said delivery line pressure and releasing said gas and liquid into said delivery line at said delivery line pressure.

3. The process according to claim 2, including passing liquid from the pump through a regulation valve to render the operating conditions of the pump as constant as possible.

4. The process of claim 2 including said first and second vessels alternatively performing functions of gas and liquid separation and the functions of compressing the gas and delivering the compressed gas and liquid into the delivery line 5. The process of claim 2 including passing the multi-phase gas-liquid mixture into a third vessel, separating the liquid and gas from said gas-liquid mixture in said third vessel under intake line pressure, utilizing said third vessel as a stand-by in a first cycle of separation of liquid, compressing said gas under intake line pressure to said delivery line pressure and delivering gas under said delivery line pressure and liquid into said delivery line and thereafter alternately performing the functions of liquid separation, stand-by and compressing the gas and delivering said gas into said delivery line.

6. The process of claim 2 including passing the multi-phase gas-liquid mixture into a third vessel, separating the liquid and gas from said gas-liquid mixture in said third vessel under inlet line pressure, utilizing said third vessel as a stand-by in a first cycle of separation of liquid, compressing said gas under intake line pressure to said delivery line pressure and delivering gas and liquid under said delivery line pressure into said delivery line and thereafter each vessel alternatively performing functions of stand-by, compressing the gas and delivering said gas into said delivery line and liquid separation.

7. A process for pumping a multi-phase gas-liquid mixture through a delivery line at a delivery line pressure comprising a) feeding the multi-phase mixture from a pressurized intake line, under the pressure of said intake line, to a gas-liquid phase separator full of liquid, separating the multi-phase mixture in said gas-liquid phase separator into a gaseous phase and a liquid phase;

b) passing the gas phase to an empty first vessel until the pressure reaches the intake line pressure;

c) simultaneously with the gas-liquid separation sending the liquid present in said gas-liquid phase separator and the liquid separated inside the gas-liquid phase separator to a pump, by means of which the liquid is pumped into a second vessel, full of gas under the intake line pressure, causing the gas contained inside said second vessel to be compressed by said liquid initially present in said gas-liquid phase separator, until said gas reaches a pressure equal to that of said delivery line; and d) causing the compressed gas and compressing liquid to leave the second vessel and enter said delivery line by introducing more liquid from said gas-liquid phase separator into said second vessel through said pump, the amount of liquid leaving said second vessel being the same as that of the liquid entering the gas-liquid phase separator.

8. A process for pumping a multi-phase gas-liquid mixture through a delivery line at a predetermined pressure comprising a) feeding the multi-phase mixture from a pressurized intake line, under the pressure of said intake line, to a first vessel full of liquid, separating the multi-phase mixture in said first vessel into a gaseous phase and a liquid phase;

b) simultaneously with the gas-liquid separation sending the liquid present in said first vessel and the liquid separated inside the first vessel to a pump, by means of which the liquid is pumped to a second vessel, full of gas under a delivery line pressure, c) causing a portion of aid gas in said second vessel under delivery line pressure to flow into a third vessel under intake line pressure until delivery line pressure is reached in said third vessel while simultaneously maintaining delivery line pressure in said second vessel by pumping the liquid from said first vessel into said second vessel; and d) causing the compressed gas and compressing liquid to leave the second vessel and enter said delivery line by introducing more liquid from said first vessel into said second vessel through the pump, the amount of liquid leaving said second vessel being the same as that of the liquid entering the first vessel.

9. The process of claim 8 wherein each vessel performs sequentially the function of taking in and separating the multi-phase mixture, standing by with gas therein under a pressure of the delivery line and delivering the gas and liquid under delivery line pressure to the delivery line.

* * * * *